US006665915B1

(12) United States Patent
Higuchi

(10) Patent No.: US 6,665,915 B1
(45) Date of Patent: Dec. 23, 2003

(54) BUCKLE

(75) Inventor: Koshiro Higuchi, Tokyo (JP)

(73) Assignee: Camel Co., Ltd., Tokyo (JP)

( * ) Notice: Subject to any disclaimer, the term of this patent is extended or adjusted under 35 U.S.C. 154(b) by 0 days.

(21) Appl. No.: 09/686,050

(22) Filed: Oct. 11, 2000

(30) Foreign Application Priority Data

Aug. 1, 2000 (JP) ..... 2000-233520

(51) Int. Cl.[7] ..... A44B 11/25
(52) U.S. Cl. ..... 24/615; 24/625
(58) Field of Search ..... 24/615, 614, 616, 24/625, 310, 197

(56) References Cited

U.S. PATENT DOCUMENTS

| | | | | |
|---|---|---|---|---|
| 5,561,891 A | * | 10/1996 | Hsieh | 24/615 X |
| 5,709,014 A | * | 1/1998 | Takahashi | 24/614 |
| 5,839,793 A | * | 11/1998 | Merrick et al. | 24/615 X |
| 5,926,928 A | | 7/1999 | Lundstedt | |
| 6,049,951 A | | 4/2000 | Anscher | |
| 6,189,348 B1 | * | 2/2001 | Huang | 24/615 X |

FOREIGN PATENT DOCUMENTS

| | | |
|---|---|---|
| DE | 299 06 344 U1 | 6/1999 |
| EP | 0 466 446 A1 | 1/1992 |
| JP | 08-154711 | 6/1996 |
| JP | 2001-1346612 | 12/2001 |
| TW | 132024 | 4/1990 |

* cited by examiner

*Primary Examiner*—Robert J. Sandy
(74) *Attorney, Agent, or Firm*—Cohen, Pontani, Lieberman & Pavane

(57) ABSTRACT

Disclosed is a buckle comprising a first section including an engagement portion for engagement with a belt-like, flexible, adjustable fastening member and a latch portion, and a second section which is structured to detachably mate with said latch portion of said first section, said engagement portion being capable of pivotally moving to said latch portion.

According to the present invention, irrespective of the direction of a pulling force applied to one end of the adjustable fastening belt engaged with the buckle, no such condition can be produced that the adjustable fastening belt is gradually loosened so that it is finally dropped off the buckle.

12 Claims, 7 Drawing Sheets

BUCKLE

BACKGROUND OF THE INVENTION

1. Field of the Invention

The present invention relates to a buckle for engagement with fastening belts or bands for a various types of bags such as a mountain-climbing bag, a sports bag and the like.

2. Description of the Prior Art

A widely used conventional buckle of this type is illustrated in FIG. 12, by way of an example. Referring to this figure, the conventional buckle consists of a male section 10 and a female section 20 that are detachably mated to each other. In such conventional buckle it is common that the male section 10 and the female section 20 are each integrally molded of any suitable materials such as plastic. The male section 10 includes a resilient latch portion 11 at the front end thereof for detachably mating with the female section 20. The male section 10 further includes an engagement portion 12 at the rear end thereof for adjustably engagement with a fastening belt or band for a bag. On the other hand, the female section 20 includes a mating recess 21 at the front end thereof for detachably receiving the resilient latch portion 11 of the male section 10. The female section 20 further includes an engagement portion 22 at the rear end thereof for fixedly engagement with a fastening belt or band for the bag. In more detail, the engagement portion 12 of the male section 10 includes an engagement rod 12A, a base rod 12B, and through-holes 12C, 12D formed at forward and back sides of the engagement rod 12A. The engagement portion 22 of the female section 20 includes an engagement rod 22A and a through-hole 22B formed at forward side of the engagement rod 22A. In actual the base rod 12B is provided with a tapered top surface 12B' downwardly extending toward the engagement rod 12A, and a corrugated bottom surface for preventing any slippage of the belt.

The conventional buckle described above is illustrated in FIG. 13, as being used for one type of a bag, for example, a sports bag. Such bag has an adjustable fastening belt 32 secured at one end to a bag body 31, and a fixed fastening belt 34 secured at one end to a cover 33 of the bag. The fastening belts 32 and 34 are engaged with the conventional buckle in the following manner. A free end of the adjustable fastening belt 32 is passed through the through-hole 12C from back to front side, and then it is passed through the through-hole 12D from front to back side. As the result the belt 32 is wound around the engagement rod 12A. Now the adjustable fastening belt 32 becomes adjustably engaged with the male section 10 of the buckle. Similarly, an end of the fixed fastening belt 34 is passed through the through-hole 22B from front to back side so that the belt 34 is wound around the engagement rod 22A. Thereafter, both ends of the belt 34 are secured to the cover 33 by a sewing process, for example. Now the fixed fastening belt 34 becomes fixedly engaged with the female section 20 of the buckle.

In this manner the bag body 31 is provided with the adjustable fastening belt 32 having the male section 10 of the buckle adjustably engaged therewith, and the cover 33 is provided with the fixed fastening belt 34 having the female section 20 fixedly engaged therewith. Then an active length of the adjustable fastening belt 32 ranging from one end portion thereof secured on the bag body 31 to a point where the belt 32 is wound around the engagement rod 12A is adjusted to suit to the thickness of the bag body 31 or the amount of goods within the bag at that moment. Thereafter the resilient latch arms 11 of the male section 10 are snapped into the mating recess 21 of the female section 20 to connect the both fastening belts 32 and 34 to each other. As the result the cover 33 is reliably fastened to the bag body 31 to close the bag.

When it is desired to open the bag or to separate the cover 33 from the bag body 31, the resilient latch arms 11 of the male section 10 are resiliently biased toward each other. Then, they are pulled out from the mating recess 21 of the female section 20 to disconnect the adjustable fastening belt 32 and the fixed fastening belt 34 from each other.

The conventional buckle having the components as described above is sufficiently effective in that fastening or separating of the bag body to or from the cover can be made simply by connection or disconnection of both fastening belts. Furthermore, adjustment of said active length of the adjustable fastening belt is facilitated to suit to the amount of goods within the bag. The conventional buckle functions satisfactorily without any problem in the normal condition wherein when the male and female sections are mated together some pulling or tensile force is exerted between the adjustable fastening belt on the male section and the fixed fastening belt on the female section.

It has been found, however, that the conventional buckle may cause some problems in the following cases. Reference is made to FIG. 14 that is a side view partially representing the relation between the bag body 31 and the cover 33, as illustrated in the perspective view of FIG. 13. As is apparent in FIG. 14, when the male section 10 having the adjustable fastening belt 32 engaged therewith (with the active length adjusted) is mated to the female section 20 having the fixed fastening belt 34 engaged therewith to fasten the bag body 31 to the cover 33, then it may happen that the engagement portion 12 of the male section 10 slightly projects beyond the bottom surface of the bag body 31 due to the thickness of the bag body 31 or the amount of the goods within the bag at that moment. In this condition, even if any pulling force indicated by an arrow "F" is applied to one end of the adjustable fastening belt 32, such pulling force "F" may not act to oppose the pulling force on the fixed fastening belt 34. Because of such pulling force "F" substantially perpendicular to the direction of the engagement portion 12 of the male section 10, it may act to gradually unwind the adjustable fastening belt 32 from the engagement rod 12A of the engagement portion 12. Even in such condition there is no possibility that the resilient latch portion 11 of the male section 10 completely disengages from the mating recess 21 of the female section 20. However, it may possible that the active length of the adjustable fastening belt 32 ranging from the end portion thereof secured to the bag body 31 to a point where the belt is wound around the engagement portion 12 of the male section 10 becomes gradually increased. This gradually decreases the fastening force of the cover 33 relative to the bag body 31 to such degree that there is no effective fastening force exerted. If the entire length of the adjustable fastening belt 32 is relatively short then the free end of the adjustable fastening belt 32 may completely disengage from the engagement portion 12 of the male section 10 so that the male section 10 may drop off, in the worst case.

SUMMARY OF THE INVENTION

In view of the above one object of the present invention is to provide a new and improved buckle in order to solve the problems in the prior art.

To attain such object the present invention provides a buckle comprising a first section including an engagement portion for engagement with a belt-like, flexible, adjustable fastening member and a latch portion, and a second section which is structured to detachably mate with said latch portion of said first section, said engagement portion being capable of pivotally moving to said latch portion.

According to one embodiment of the present invention said first section is a male type and said second section is a female type.

According to another embodiment of the present invention said first section is a female type and said second section is a male type.

According to further embodiment of the present invention said latch portion includes pivot shafts at the opposite sides of a base portion thereof; and said engagement portion includes pivot holes for receiving said pivot shafts, whereby said pivotal movement of said engagement portion is effected about said pivot shafts and pivot holes mated to each other.

According to yet further embodiment of the present invention said latch portion includes pivot holes at the opposite sides of a base portion thereof; and said engagement portion includes pivot shafts for mating to said pivot holes, whereby said pivotal movement of said engagement portion is effected about said pivot shafts and pivot holes mated to each other.

According to yet further embodiment of the present invention said engagement portion and said latch portion are connected through a flexible thin member, whereby said pivotal movement of said engagement portion is effected about said flexible this member.

According to yet further embodiment of the present invention said engagement portion includes an engagement rod and a base rod; said base rod includes a tapered top surface downwardly extending toward said engagement rod; a first through-hole is formed between said base portion of the latch portion and said engagement rod; a second through-hole is formed between said engagement rod and said base rod; whereby an end portion of said adjustable fastening member is passed through said first through-hole from the back to front side, and then it is passed through said second through-hole from front to back side, so that said adjustable fastening member is wound around said engagement rod; and said adjustable fastening member is kept wound between an end portion of said tapered surface of said base portion and said engagement rod.

In another aspect the present invention provides a buckle comprising a first section including an engagement portion for engagement with a belt-like, flexible, fixed fastening member and a latch portion, and a second section which is structured to detachably mate with said latch portion of said first section and including an engagement portion for engagement with an adjustable fastening member, said engagement portion of said first section being capable of pivotally moving to said latch portion.

DESCRIPTION OF THE PREFERRED EMBODIMENTS

Now the present invention will be described in more detail with reference to FIGS. 1 to 11 of the accompanying drawings.

Figure 1:
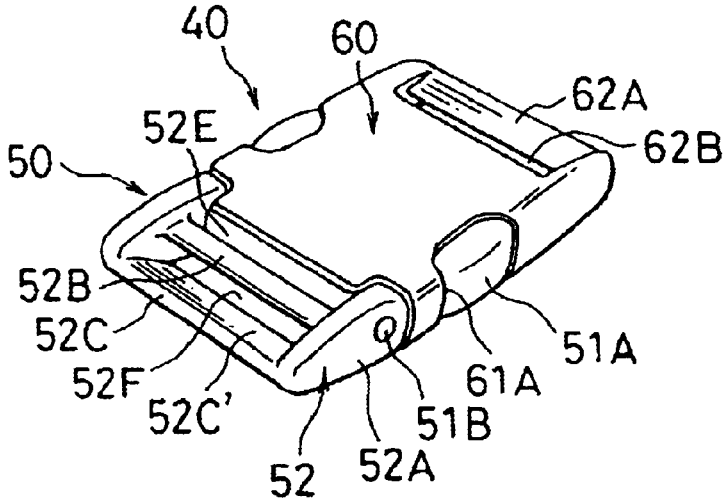
FIG. 1 is a schematic perspective view representing a buckle according to one embodiment of the present invention when it is in mated condition.
Figure 2:
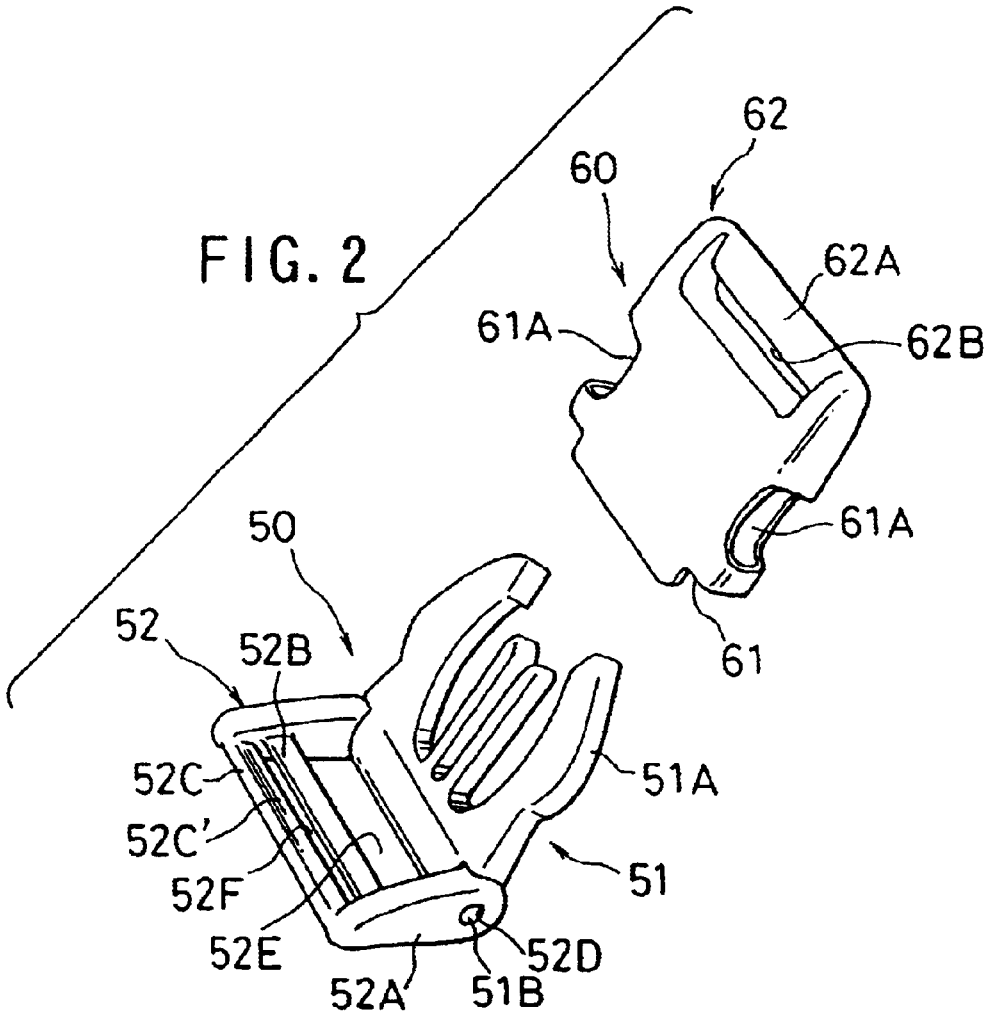
FIG. 2 is a perspective view representing the buckle of FIG. 1 when it is in unmated condition.
Figure 3:
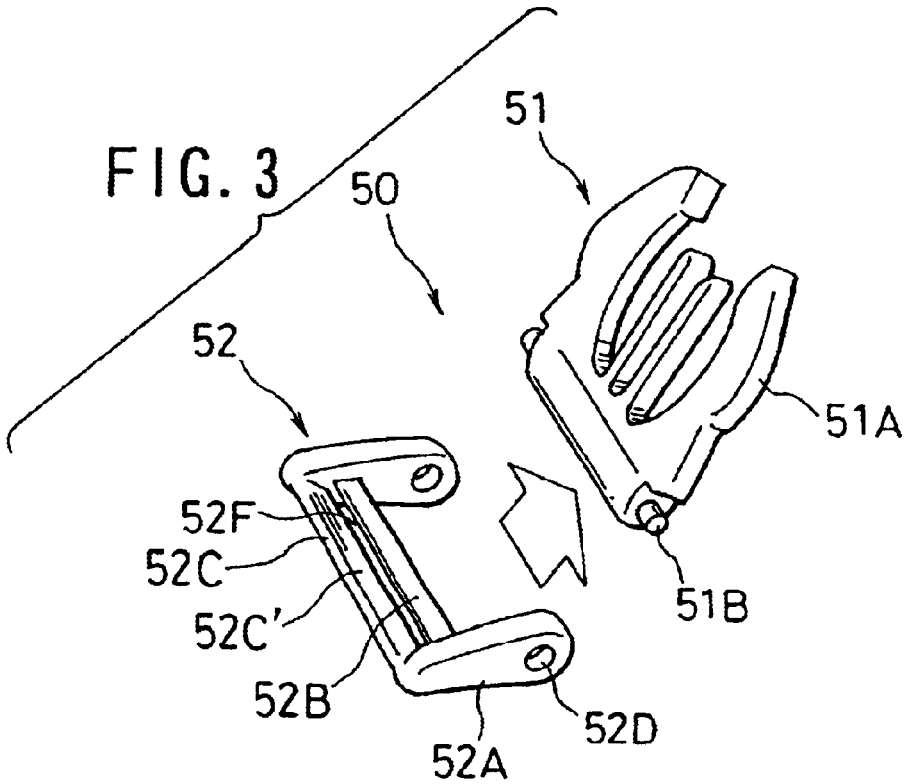
FIG. 3 is an exploded perspective view representing a male section of the buckle of FIG. 1.

FIG. 1 is a schematic perspective view representing a buckle according to one embodiment of the present invention when it is in mated condition. FIG. 2 is a perspective view representing the buckle of FIG. 1 when it is in unmated condition. FIG. 3 is an exploded perspective view representing a female section of the buckle of FIG. 1. As can be seen in FIGS. 1 to 3, the buckle 40 in this embodiment comprises a male section 50 and a female section 60. As is clearly shown in FIG. 2, the male section 50 includes resilient latch portion 51 at the front end thereof for detachably mating with the female section 60. The male section 50 further includes an engagement portion 52 at the rear end thereof for adjustably engagement with a fastening belt or band for a bag. On the other hand, the female section 60 includes a mating recess 61 at the front end thereof for detachably receiving the resilient latch portion 51 of the male section 50. The female section 60 further includes an engagement portion 62 at the rear end thereof for fixedly engagement with a fastening belt or band for the bag.

Referring more particularly to FIG. 3, the resilient latching portion 51 and the engagement portion 52 of the mating section 50 are formed as the separate components according to the present invention. Each of the resilient latch portion 51 and the engagement portion 52 may be integrally molded from any suitable material, such as plastic. In more detail, the resilient latch portion 51 is provided with latch arms 51A at the opposite sides and at the front end thereof. These latch arms 51A are arranged so that they are inwardly biased toward each other. In addition, pivot shafts 51B are provided at the opposite sides of a base of the resilient latch portion 51. On the other hand, the engagement portion 52 is provided with forwardly extending side arms 52A at the opposite sides thereof. In addition, an engagement rod 52B and a base rod 52C are formed to connect between the side arms 52A. The base rod 52C is provided with a tapered top surface 52C' downwardly extending toward the engagement rod 52B, and a corrugated bottom surface (not shown in the figure) for preventing any slippage of the belt. Furthermore, pivot holes 52D are formed in the side arms 52A at the positions near the front end thereof These pivot holes 52D are arranged to mate with the pivot shafts 51B on the opposite sides of the base of the resilient latch portion 51. The side arms 52A of the engagement portion 52 can be resiliently biased outwardly to some degree at the front ends thereof. Therefore, the engagement portion 52 can be assembled with the resilient latch portion 51 by inserting the pivot shafts 51B into the pivot holes 52D while biasing the front ends of the side arms 52A slightly outwardly.

FIG. 2 represents the condition where the engagement portion 52 has been assembled with the resilient latch portion 51. In this condition the engagement portion 52 can pivotally be moved freely relative to the resilient latch portion 51 about the pivot axis 51B. Also in this condition a through-hole 52E is produced between the base of the resilient latch portion 51 and the engagement rod 52B. In addition a through-hole 52F is present between the engagement rod 52B and the base rod 52C.

The female section 60 may be integrally molded from any suitable material such as plastic. As can be seen in FIG. 2, the engagement portion 62 of the female section 60 includes an engagement rod 62A, and a through-hole 62B present in front of the engagement rod 62A. The engagement portion 62 further includes latch windows 61A formed at the both sides of the mating recess 61. Referring again to FIG. 1, in order to connect the male section 50 with the female section 60, the resilient latch portion 51 of the male section 50 is inserted into the mating recess 61 of the female section 60 while resiliently biasing the latch arms 51A inwardly. Then the outwardly curved portions of the latch arms 51A become snapped into the latch windows 61A. As the result the male section 50 and the female section 60 are securely locked and kept in place to each other. The female section 60 in this embodiment may have the same construction as that already described with reference to the prior art, and therefore, there is no need for further description of the female section 60.

Now the description will be made in terms of the operation and the application of the buckle according to the embodiment as described above.

Figure 4:
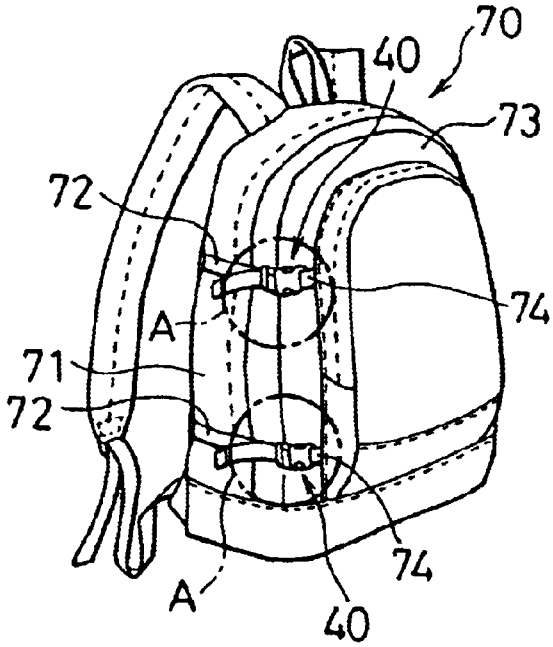
FIG. 4 is a schematic perspective view representing one example case where the buckle of FIG. 1 is used for a mountain-climbing bag.
Figure 5:
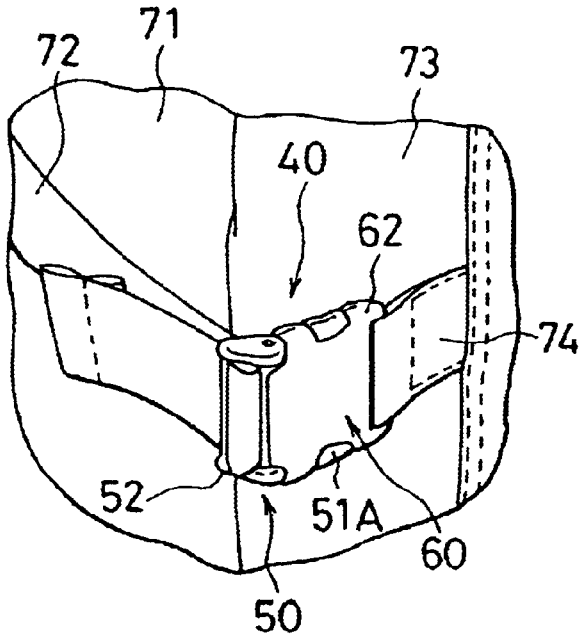
FIG. 5 is an enlarged view representing a portion encircled by a circle "A" in FIG. 4.

FIG. 4 is a schematic perspective view representing one application of the buckle 40 wherein it is used for a mountain-climbing bag. FIG. 5 is an enlarged view representing a portion encircled by a circle "A" in FIG. 4. As is apparent in FIGS. 4 and 5, the buckle 40 is used for the mountain-climbing bag 70 having an adjustable fastening belt 72 secured at one end to a bag body 71 and a fixed fastening belt 74 secured at one end to a cover 73. The cover 73 functions to open and close an opening of the bag body 71. The adjustable fastening belt 72 is engaged with the buckle 40 in the following manner. The free end of the adjustable fastening belt 72 is passed through the through-hole 52E from back to front side, and then it is passed through the through-hole 52F from front to back side. As the result the belt 72 is wound around the engagement rod 52B. This makes the adjustable fastening belt 72 adjustably engaged with the male section 50 of the buckle 40. In this connection, it is important to note that, as far as some pulling force is applied to one end of the adjustable fastening belt 72 in the backward direction relative to the engagement portion 52 and in a plane substantially same as that where the engagement portion 52 exists, the adjustable fastening belt 72 can be kept wound around the engagement rod 52B, due to the interaction produced between the engagement rod 52B and the end portion of the downwardly extending tapered top surface 52C' and the corrugated bottom surface (if present) of the base rod 52C. Therefore there is no such condition occurred that the adjustable fastening belt 72 is gradually moved and finally the free end thereof becomes dropped off the engagement portion 52, as in the case of the prior art buckle. On the other hand, the fixed fastening belt 74 is engaged with the buckle 40 in the following manner. One end of the fixed fastening belt 74 is passed through the through-hole 62B from front to back side so that the belt 74 is wound around the engagement rod 62A. Thereafter, both ends of the belt 74 are secured to the cover 73 by a sewing process, for example. Then the fixed fastening belt 74 becomes fixedly engaged with the female section 60 of the buckle 40.

In this manner the bag body 71 is provided with the adjustable fastening belt 72 having the male section 50 of the buckle 40 adjustably engaged therewith, and the cover 73 is provided with the fixed fastening belt 74 having the female section 60 fixedly engaged therewith. Then the active length of the adjustable fastening belt 72 ranging from one end portion thereof secured on the bag body 71 to a point where the belt 72 is wound around the engagement rod 52B of the engagement portion 52 of the male section 50 is adjusted to suit to the thickness of the bag body 71 or the amount of goods within the bag at that time. Thereafter the latch arms 51A of the resilient latch portion 51 of the male section 50 are snapped into the mating recess 61 of the female section 60 to connect the both fastening belts 72 and 74 to each other. As the result the cover 73 is reliably fastened to the bag body 71 to close the bag.

When it is desired to open the bag or to separate the cover 73 from the bag body 71, the latch arms 51A of the resilient latch portion 51 of the male section 50 are resiliently inwardly biased toward each other. Then, they are disengaged from the latch windows 61A and pulled out from the mating recess 61 of the female section 60 to disconnect the adjustable fastening belt 72 and the fixed fastening belt 74 from each other.

Figure 6:
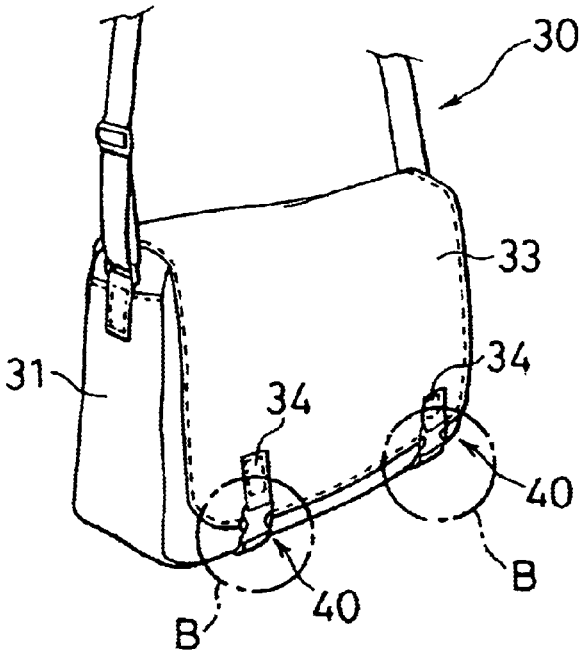
FIG. 6 is a schematic perspective view representing another example case where the buckle of FIG. 1 is used for a sports bag.
Figure 7:
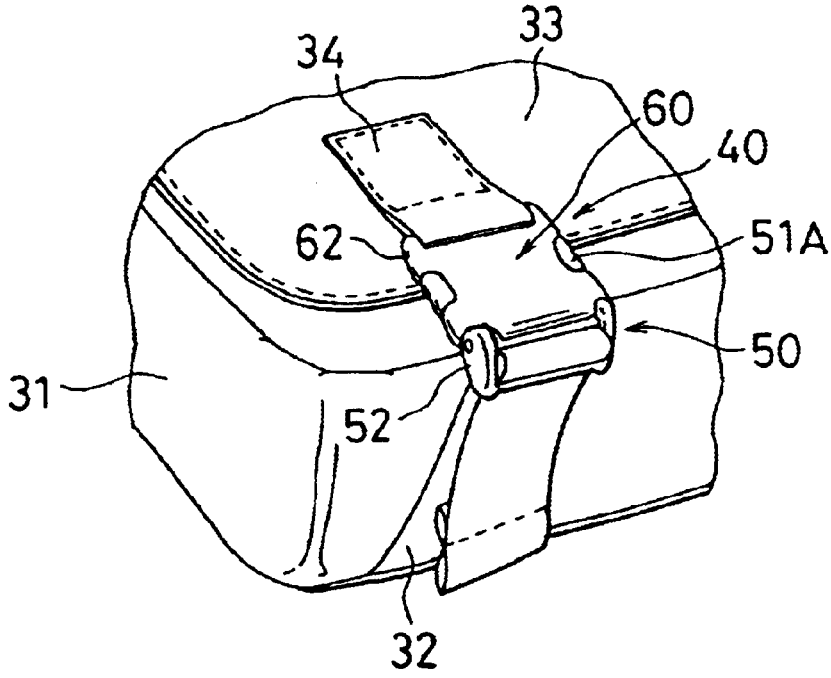
FIG. 7 is an enlarged view representing a portion encircled by a circle "B" in FIG. 6.

FIG. 6 is a schematic perspective view representing another application of the buckle 40 wherein it is used for a sports bag. FIG. 7 is an enlarged view representing a portion encircled by a circle "B" in FIG. 6. As is apparent in FIGS. 6 and 7, the buckle 40 is used for the sports bag 30 having an adjustable fastening belt 32 secured at one end to a bag body 31 and a fixed fastening belt 34 secured at one end to a cover 33. The cover 33 functions to open and close an opening of the bag body 31. The fastening belt 32 and 34 are engaged with the buckle 40 in the following manner. The free end of the adjustable fastening belt 32 is passed through the through-hole 52E from back to front side, and then it is passed through the through-hole 52F from front to back side. As the result the belt 32 is wound around the engagement rod 52B. This makes the adjustable fastening belt 32 adjustably engaged with the male section 50 of the buckle 40. On the other hand, one end of the fixed fastening belt 34 is passed through the through-hole 62B from front to back side so that the belt 34 is wound around the engagement rod 62A. Thereafter, both ends of the belt 34 are secured to the cover 33 by a sewing process, for example. Then the fixed fastening belt 34 becomes fixedly engaged with the female section 60 of the buckle 40.

In this manner the bag body 31 is provided with the adjustable fastening belt 32 having the male section 50 of the buckle 40 adjustably engaged therewith, and the cover 33 is provided with the fixed fastening belt 34 having the female section 60 fixedly engaged therewith. Then the active length of the adjustable fastening belt 32 ranging from one end portion thereof secured on the bag body 31 to a point where the belt 72 is wound around the engagement rod 52B of the engagement portion 52 of the male section 50 is adjusted to suit to the thickness of the bag body 31 or the amount of goods within the bag at that time. Thereafter the latch arms 51A of the resilient latch portion 51 of the male section 50 are snapped into the mating recess 61 of the female section 60 to connect the both fastening belts 32 and 34 to each other. As the result the cover 33 is reliably fastened to the bag body 31 to close the bag.

When it is desired to open the bag or to separate the cover 33 from the bag body 31, the latch arms 51A of the resilient latch portion 51 of the male section 50 are resiliently inwardly biased toward each other. Then, they are disengaged from the latch windows 61A and pulled out from the mating recess 61 of the female section 60 to disconnect the adjustable fastening belt 32 and the fixed fastening belt 34 from each other.

In the embodiment as shown FIGS. 4 and 5, when the male section 50 having the adjustable fastening belt 72 engaged therewith (with the active length adjusted) is mated to the female section 60 having the fixed fastening belt 74 engaged therewith to fasten the bag body 71 to the cover 73, then it may happen that the engagement portion 52 of the male section 50 slightly projects beyond the side surface of the bag body 71 due to the thickness of the bag body 71 or the amount of the goods within the bag body 71. In similar manner, in the embodiment as shown FIGS. 6 and 7, when the male section 50 having the adjustable fastening belt 32 engaged therewith (with the active length adjusted) is mated to the female section 60 having the fixed fastening belt 74 engaged therewith to fasten the bag body 31 to the cover 33, then it may also possible that the engagement portion 52 of the male section 50 slightly projects beyond the bottom surface of the bag body 31 due to the thickness of the bag body 31 or the amount of the goods within the bag body 31. In such condition, however, the buckle 40 of the present invention does not produce any problems at all due to the construction of the buckle as described above.

Figure 8:
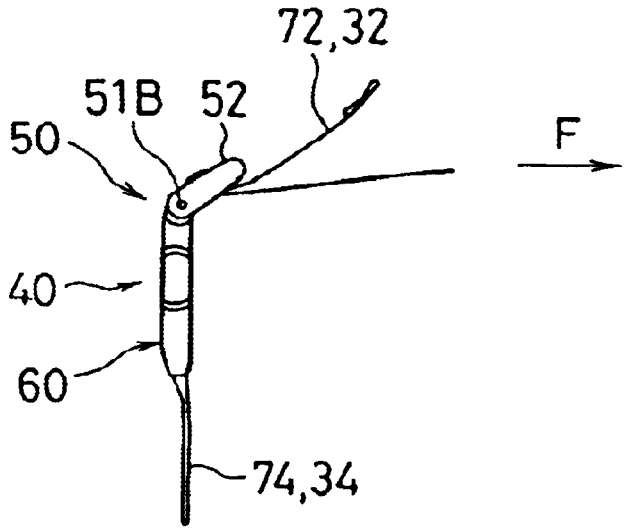
FIG. 8 is a view representing the relation between an engagement portion of a male section of the buckle and an adjustable fastening belt in the condition as described with reference to FIGS. 4 to 7.

The reason for which will be described hereunder. FIG. 8 is a schematic view representing the relation between the engagement portion 52 of the male section 50 of the buckle 40 and the adjustable fastening belt 72 or 32 under the condition as described above with reference to FIGS. 4, 5 and FIGS. 6, 7. In such condition, even if any pulling force indicated by an arrow "F" is applied to one end of the adjustable fastening belt 72 or 32, such pulling force "F" may not act to oppose the pulling force on the fixed fastening belt 74 or 34. However, such pulling force "F" is substantially perpendicular to the direction of the engagement portion 52 of the male section 50. Therefore, the engagement portion 52 is subjected to this pulling force "F" through a portion of the adjustable fastening belt 32 that is wound around the engagement rod 52B. As the result the engagement portion 52 is pivotally moved in clockwise about the pivot axis 51B, as shown in FIG. 8. Such pivotal movement of the engagement portion 52 can put the force "F" in a plane substantially same as that where the engagement portion 52 is present. Accordingly the adjustable fastening belt 72 or 32 can be kept firmly wound around the engagement rod 52B of the engagement portion 52, thereby preventing the belt 72 or 32 from gradually unwinding.

Figure 9:
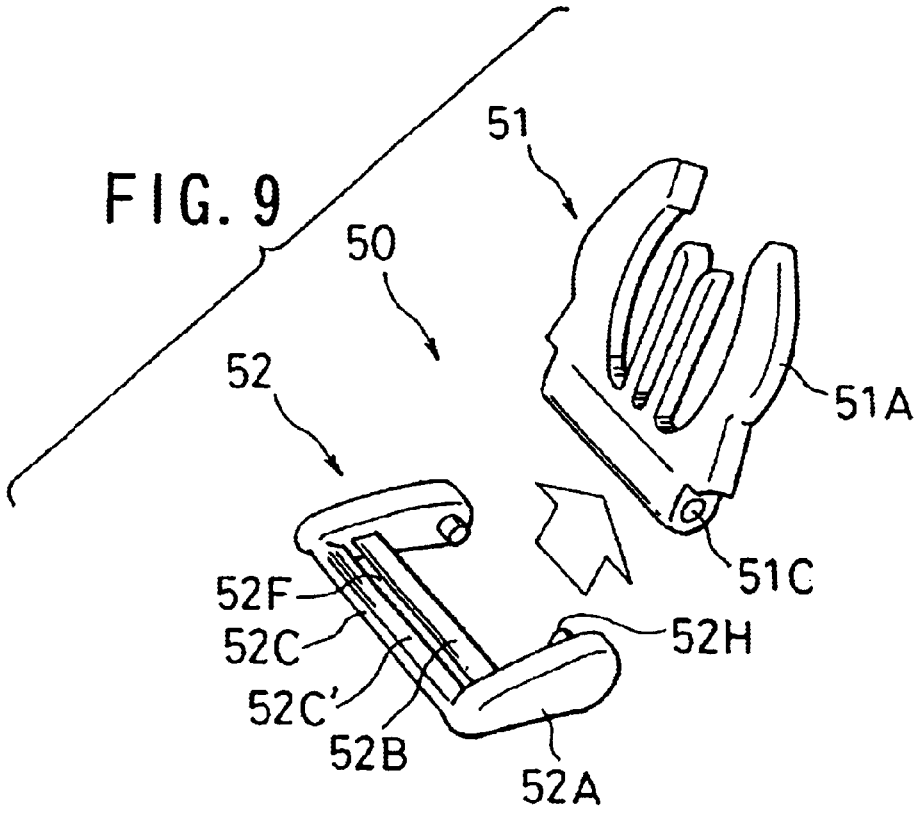
FIG. 9 is a view similar to FIG. 3, but representing a male section of a buckle according to another embodiment of the present invention.

FIG. 9 is a view similar to FIG. 3, but representing a male section of a buckle according to another embodiment of the present invention. The male section of the buckle in this embodiment has substantially same construction as that of FIG. 1, and therefore, the components corresponding to those in FIG. 1 are indicated by the same reference numerals, and only difference therebetween will be described hereunder. The male section 50 in the embodiment in FIG. 1 includes the pivot shafts 51B at the opposite sides of the base of the resilient latch portion 51 and the pivot holes 52D in the side arms 52A of the engagement portion 52, as described above. In contrast thereto, the male section 50 in the embodiment in FIG. 9 includes pivot holes 51C at the opposite sides of the base of the resilient latch portion 51 and pivot shafts 52H on the side arms 52A of the engagement portion 52. The pivot shafts 52H on the engagement portion 52 are mated to the pivot holes 51C in the base of the resilient latch portion 51 to couple the engagement portion 52 to the resilient latch portion 51. Therefore the engagement portion 52 is made freely pivotally moved to the resilient latch portion 51, thereby providing the same effect as described above. In this embodiment the pivot shafts 52H are each provided on inner surfaces of both side arms 52A, but the present invention is not limited to such construction. Alternatively the pivot shafts 52H may be replaced with only one pin spanned across the both side arms 52A.

In the embodiments as described above the pivotally moved engagement portion is provided on the male section of the buckle. However, the present invention is not limited to such construction and such pivotally moved engagement portion may be provided on the female section of the buckle. In addition, means for pivotally moving the engagement portion relative to the resilient latch portion is not limited to the combination of pivot shaft and pivot hole as described above, but it may include a hinge or other well known means. Furthermore, in the embodiment as described above, the resilient latch portion and the engagement portion pivotally moved thereto are each molded independently as the discrete components. However, the present invention can also cover such construction that the resilient latch portion and the engagement portion are integrally molded as one unit in which they are connected through a flexible thin bride portion about which the resilient latch portion is pivotally moved relative to the engagement portion.

Figure 10:
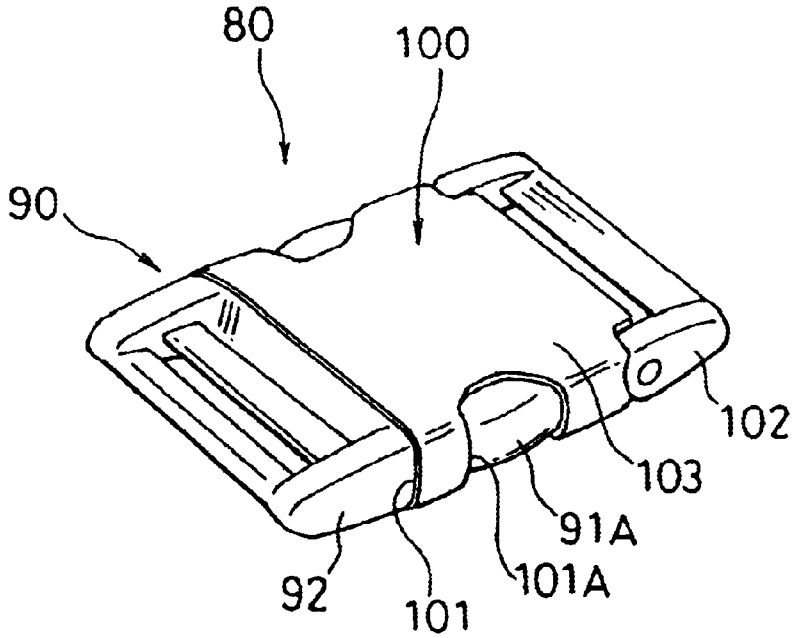
FIG. 10 is a schematic perspective view representing a buckle according to further embodiment of the present invention when it is in mated condition.
Figure 11:
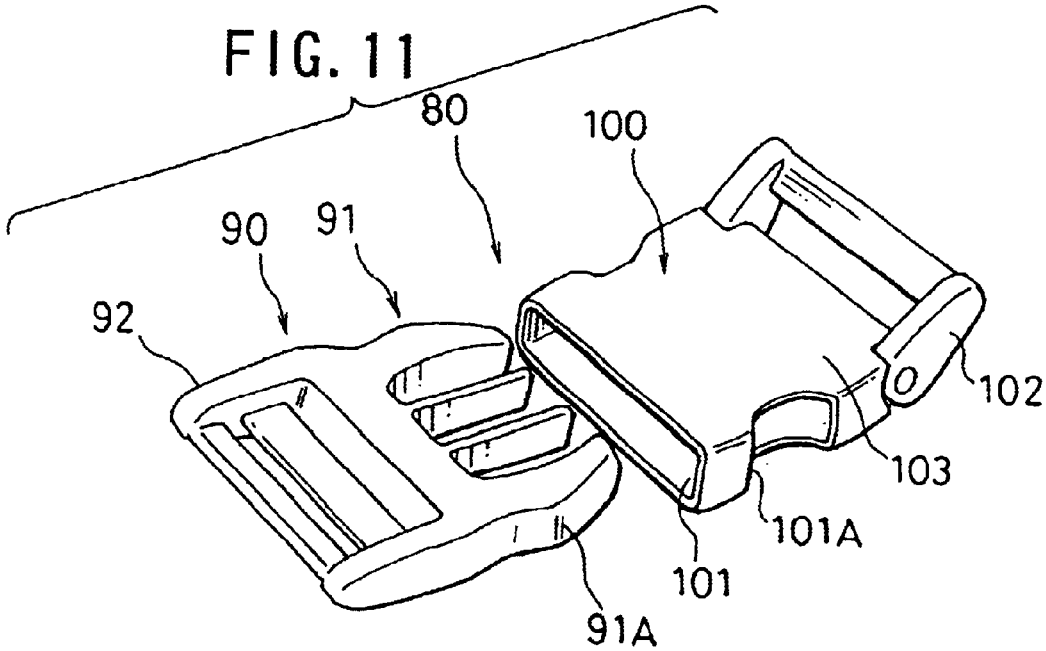
FIG. 11 is a perspective view representing the buckle of FIG. 10 when it is in unmated condition.
Figure 12:
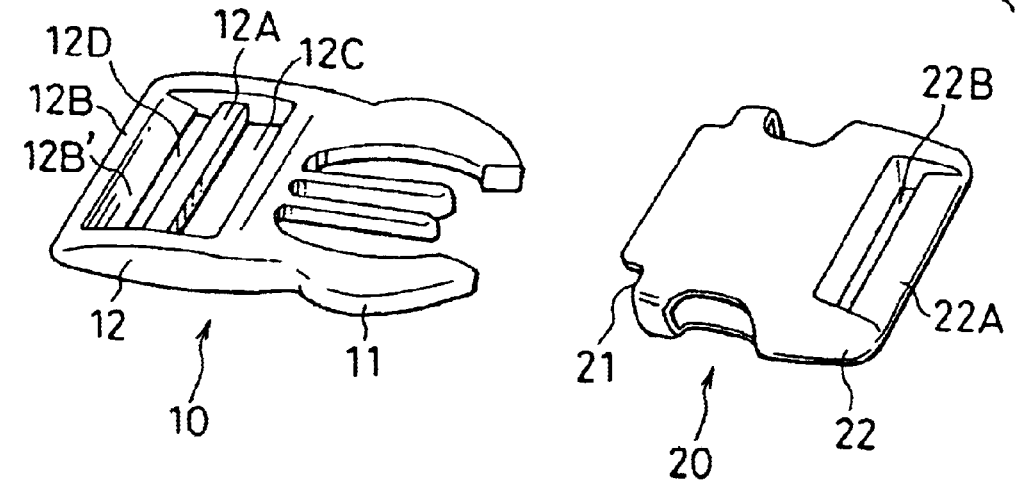
FIG. 12 PRIOR ART
FIG. 12 is a schematic perspective view representing a conventional buckle, by way of an example.
Figure 13:
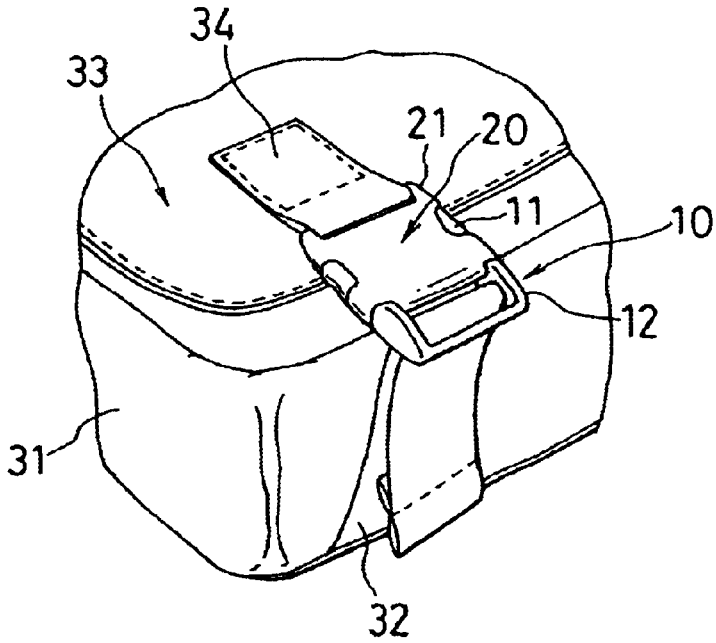
PRIOR ART FIG. 13
FIG. 13 is a perspective view partly representing one example case where the conventional buckle of FIG. 12 is used for a bag.
Figure 14:
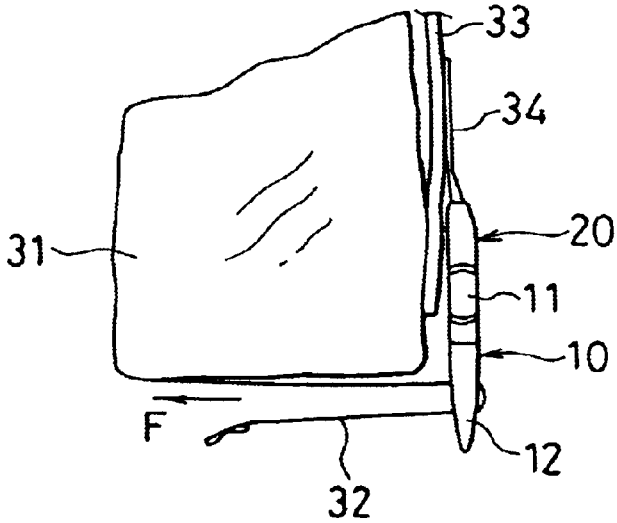
PRIOR ART FIG. 14
FIG. 14 is a side view partially representing the relation between a bag body and a cover of the bag of FIG. 13.

FIG. 10 is a schematic perspective view representing a buckle according to further embodiment of the present invention. FIG. 11 is a view representing the buckle of FIG. 10, but in such condition that male and female sections are separated. The buckle 80 in this embodiment comprises a male section 90 and a female section 100. In this embodiment the male section 90 includes an engagement portion 92 for an adjustable fastening belt and an resilient latch portion 91 having latch arms 91A, both of which portions are integrally molded. Therefore the engagement portion 92 is fixedly connected with the resilient latch portion 91 so that they are not pivotally moved to each other 91. The male section 90 is substantially identical in construction to that of the conventional buckle, as described with reference to FIG. 12. Accordingly no further description for the male section 90 will be made here. On the other hand, the female section 100 includes an engagement portion 102 for a fixed fastening belt that can be pivotally moved relative to a mating portion 103 having a recess 101 for receiving the resilient latch portion 91 of the male section 80. The mating portion 103 includes latch windows 101A at the opposite sides thereof, both of which windows communicating with the recess 101. When mating the male section 90 to the female section 100, the latch arms 91A of the male section 90 are snapped into the latch windows 101A so that the male and female sections can be keep connected. The way of pivotally moving the engagement portion 102 to the mating portion 103 may be same as that already described with reference to FIGS. 1 to 3 and 9, and therefore, no further description will be made here.

As compared to the buckle 40, as already described with reference to FIGS. 1 to 9, the buckle 80 in this embodiment has different construction in that the engagement portion 92 of the male section 90 is not pivotally moved. But, instead, the engagement portion 102 of the female section 100 is pivotally moved. However, such construction of the buckle 80 can still provide the same advantages as those for the buckle 40 in FIGS. 1 to 9.

In addition, in the buckle 80, the engagement portion 92 of the male section 90 is used for engagement with the adjustable fastening belt and the engagement portion 102 of the female section 100 is for engagement with the fixed fastening belt. However the buckle 80 may have the inverse arrangement in which the engagement portion 92 of the male section 90 is used for engagement with the fixed fastening belt and the engagement portion 102 of the female section 100 is for engagement with the adjustable fastening belt. In this case the engagement portion 92 of the male section 90 may be pivotally moved.

It is apparent from the foregoing that the present invention provides a new and improved buckle in which, irrespective of the direction of a pulling force applied to one end of an adjustable fastening belt engaged with the buckle, no such condition can be produced that the adjustable fastening belt is gradually loosened so that it is finally dropped off the buckle. Accordingly the buckle of the present invention can always maintain better fastened condition for a bag, irrespective of the thickness of the bag that is fastened by use of the buckle.

What is claimed is:

1. A buckle comprising;

a first section including a latch portion and an engagement portion having adjustment means for enabling adjustable engagement with a belt like, flexible, adjustable first fastening member, said engagement portion being capable of pivotally moving relative to said latch portion: and a second section having two opposite ends, with one of said ends being structured to detachably mate with said latch portion of said first section and another of said ends being adapted to engage a second fastening member;

wherein said second fastening member extends away from the buckle at said other end of said second section; and wherein said latch portion includes pivot shafts at the opposite sides of a base portion thereof; and said engagement portion includes pivot holes for receiving said pivot shafts, whereby said pivotal movement of said engagement portion is effected about said pivot shafts and pivot holes mated to each other.

2. A buckle according to claim 1 in which said first section is a male type and said second section is a female type.

3. A buckle according to claim 1 in which said first section is a female type and said seconds section is a male type.

4. A buckle comprising a first section including a latch portion and an engagement portion having adjustment means for enabling adjustable engagement with a belt-like, flexible, adjustable first fastening member, said engagement portion being capable of pivotally moving relative to said latch portion; and a second section having two opposite ends, with one of said ends being structured to detachably mate with said latch portion of said first section and another of said ends being adapted to engage a second fastening member;

wherein said second fastening member extends away from the buckle at said other end of said second section; and wherein said engagement portion and said latch portion are connected through a flexible thin member, whereby said pivotal movement of said engagement portion is effected about said flexible thin member.

5. A buckle according to claim 4 in which said first section is a male type and said second section is a female type.

6. A buckle according to claim 4 in which said first section is a female type and said second section is a male type.

7. A buckle comprising:

a first section including a latch portion and an engagement portion having adjustment means for enabling adjustable engagement with a belt like, flexible, adjustable first fastening member, said engagement portion being capable of pivotally moving relative to said latch portion; and a second section having two opposite ends, with one of said ends being structured to detachably mate with said latch portion of said first section and another of said ends being adapted to engage a second fastening member;

wherein said second fastening member extends away from the buckle at said other end of said second section; and wherein said engagement portion includes an engagement rod and a base rod, said base rod includes a tapered top surface downwardly extending toward said engagement rod, a first through-hole formed between said base portion of the latch portion and said engagement rod, and a second through-hole formed between said engagement rod and said base rod, whereby an end portion of said adjustable fastening member is passed through said first through-hole from the back to the front side, and then passed through said second through-hole from front to back side, so that said adjustable fastening member is wound around said engagement rod, and said adjustable fastening member is kept wound between an end portion of said tapered surface of said base portion and said engagement rod.

8. A buckle according to claim 7 in which said first section is a male type and said second section is a female type.

9. A buckle according to claim 7 in which said first section is a female type and said second section is a male type.

10. A buckle according to claim 7 wherein said latch portion includes pivot shafts at the opposite sides of a base portion thereof; and said engagement portion includes pivot holes for receiving said pivot shafts, whereby said pivotal movement of said engagement portion is effected about said pivot shafts and pivot holes mated to each other.

11. A buckle according to claim 7 wherein said latch portion includes pivot holes at the opposite sides of a base portion thereof; and said engagement portion includes pivot shafts for mating to said pivot holes, whereby said pivotal movement of said engagement portion is effected about said pivot shafts and pivot holes mated to each other.

12. A buckle according to claim 7 wherein said engagement portion and said latch portion are connected through a flexible thin member, whereby said pivotal movement of said engagement portion is effected about said flexible thin member.

* * * * *